US010846959B2

(12) United States Patent
Serfaty et al.

(10) Patent No.: US 10,846,959 B2
(45) Date of Patent: Nov. 24, 2020

(54) SYSTEM AND METHOD FOR OPENING A VAULT

(71) Applicants: Nir Serfaty, Herzelya (IL); Barak Yanir, Lehavim (IL); Dan Mamet, Petah Tikva (IL)

(72) Inventors: Nir Serfaty, Herzelya (IL); Barak Yanir, Lehavim (IL); Dan Mamet, Petah Tikva (IL)

( * ) Notice: Subject to any disclaimer, the term of this patent is extended or adjusted under 35 U.S.C. 154(b) by 0 days.

(21) Appl. No.: 16/471,010

(22) PCT Filed: Dec. 21, 2017

(86) PCT No.: PCT/IL2017/051378
§ 371 (c)(1),
(2) Date: Jun. 19, 2019

(87) PCT Pub. No.: WO2010/116306
PCT Pub. Date: Jun. 28, 2018

(65) Prior Publication Data

US 2020/0090439 A1 Mar. 19, 2020

(30) Foreign Application Priority Data

Dec. 25, 2016 (IL) ..... 249759

(51) Int. Cl.
*G07C 9/00* (2020.01)
*E05B 17/22* (2006.01)
(Continued)

(52) U.S. Cl.
CPC ..... *G07C 9/00309* (2013.01); *E05B 17/226* (2013.01); *E05B 39/00* (2013.01);
(Continued)

(58) Field of Classification Search
CPC ... G07C 9/00309; E05B 17/226; E05B 39/00; E05B 65/0075; E05G 1/04; E05G 1/10; G07F 19/206
(Continued)

(56) References Cited

U.S. PATENT DOCUMENTS

| | | | | |
|---|---|---|---|---|
| 2009/0144151 | A1 | 6/2009 | Pajot | |
| 2009/0219133 | A1* | 9/2009 | Woodard | G07C 9/00571 340/5.65 |
| 2020/0189476 | A1* | 6/2020 | Consolacion | G07C 9/00912 |

FOREIGN PATENT DOCUMENTS

| | | | |
|---|---|---|---|
| CN | 202280353 U | | 6/2012 |
| EP | 2447457 | * | 2/2012 |
| EP | 2447457 A1 | | 5/2012 |

OTHER PUBLICATIONS

Written Opinion in PCT/2017/051378 dated Feb. 6, 2018.
International Search Report in PCT/2017/051378 dated Feb. 6, 2018.

* cited by examiner

*Primary Examiner* — Omar Casillashernandez
(74) *Attorney, Agent, or Firm* — Manelli Selter PLLC; Edward Stemberger

(57) ABSTRACT

A method of using a vault, comprising: providing a plurality of vaults, each comprising a processor; providing a user application (UA) running on a user's mobile communication device, the UA comprising a Graphical User Interface (GUI); providing a system server communicating bi-directionally over an electronic communications network with the UA; providing a vault ID to the GUI; identifying the vault location, providing a tariff for using the identified vault to the UA and receiving the user's acceptance; simultaneously generating an identical initial code by the system server and by the vault and providing the initial code to the UA;
(Continued)

providing by the user the initial code to the vault; validating the initial code by the vault; providing by the user a personal code to the vault; and unlocking the vault.

17 Claims, 5 Drawing Sheets

(51) Int. Cl.

| | |
|---|---|
| ***E05B 39/00*** | (2006.01) |
| ***E05B 65/00*** | (2006.01) |
| ***E05G 1/04*** | (2006.01) |
| ***E05G 1/10*** | (2006.01) |
| ***G07F 19/00*** | (2006.01) |

(52) U.S. Cl.
CPC ..... *E05B 65/0075* (2013.01); *E05G 1/04* (2013.01); *E05G 1/10* (2013.01); *G07F 19/206* (2013.01)

(58) Field of Classification Search
USPC ..... 340/5.73
See application file for complete search history.

SYSTEM AND METHOD FOR OPENING A VAULT

TECHNICAL FIELD

The present invention relates to a method for opening a vault or safe responsive to two security codes.

CROSS-REFERENCE TO RELATED PATENT APPLICATIONS

This patent application claims priority from and is related to Israeli Patent Application Serial Number 249759, filed 25 Dec. 2016, this Israeli Patent Application incorporated by reference in its entirety herein.

BACKGROUND

The term "vault" as used throughout this specification covers any type of safety boxes, such as safe deposits (i.e. bank vaults) and particularly ATM (Automated Teller Machine) and SST (Self Service Terminal) devices, which are prevented from an unauthorized access and which are equipped with mechanical and/or electromechanical lock devices and are geographically stationary or mobile.

International patent publication no. WO2009056900 A1 discloses a method of opening a terminal vault, based on a security code transmitted by a remote host computer. The method comprises encrypted keys transmitted between the vault and a host computer.

U.S. Pat. No. 6,791,450B2 discloses a system of locker compartments at various locations, controlled by a central system processor. A communication system from the central processor to all locations, and all lockers within a location, enables central control of rewritable locker access codes, reservation of appropriate lockers for delivery of orders, and monitoring of status of all lockers in the system. The assignment of lockers and codes can be web-based, and can be done by a vendor, a delivery company or an online customer.

EP Published Patent Application no. EP2447457 discloses an apparatus, systems, and methods to receive reservation requests for travel reservations associated with a common carrier. Responsive to receiving a request, an access control code to control access to a lockable compartment within a vehicle designated to provide transportation associated with the travel reservation may be generated. The compartment may be a luggage compartment, such as an overhead bin on an airplane. The code may be transmitted to a mobile device carried by the passenger associated with the reservation, and used to provide lockable access to the compartment.

US Published Patent Application no. US2009/0144151 discloses an automated rental system comprising: an object for rent which is provided with an identification code, an auxiliary element functionally associated with the object for rent and comprising a remotely activated activation/deactivation system, a portable device, such as a mobile telephone, comprising a wireless telecommunication interface, a central unit comprising means for bidirectional communication with said auxiliary element and said portable device; said central unit further comprising means for processing said identification code, means for acting on said activation/deactivation system, means for recording the duration of use of the object for rent, and means for managing the accounts of the persons using said object for rent.

CN Granted Utility Model no. CN202280353 discloses an intelligent safety box comprising a safety box body, an information acquisition unit, a control unit, a lock unit, an alarm unit, an operation unit and a power circuit unit. An intelligent safety controller is formed by the units to achieve active and intelligent prevention of burglary. The intelligent safety box has the advantages that a user status can be automatically identified, a non-registered user cannot use the safety box, the functions of automatic alarm of burglary conditions and automatic video and storage of image and sound data and use information of the safety box are provided, and the functions of prevention with one key and prevention removal with one key are further provided, thereby being high in intelligent degree and reliable in safety performance, achieving the change from passive prevention of burglary to active prevention of burglary, being simple in operation, convenient and practical and being a safety defender of important documents, data, cash and valuables for companies, units and families.

SUMMARY

According to a first aspect of the present invention there is provided a method of using a vault, comprising: providing a plurality of vaults, each comprising a processor; providing a user application (UA) running on a user's mobile communication device, said UA comprising a Graphical User Interface (GUI); providing a system server communicating bi-directionally over an electronic communications network with said UA; providing a vault ID to said GUI; identifying said vault location, providing a tariff for using said identified vault to said UA and receiving said user's acceptance; simultaneously generating an identical initial code by said system server and by said vault and providing said initial code to said UA; providing by said user said initial code to said vault; validating said initial code by said vault; providing by said user a personal code to said vault; and unlocking said vault.

The vault ID may comprise one of a number, a name and an alphanumeric indicia.

Providing a vault ID may comprise entering the vault ID into said GUI.

providing a vault ID may comprise capturing an image of said vault ID with capturing means of said user's mobile communication device.

The method may further comprise identifying said vault ID from said captured image.

Identifying may comprise applying an Optical Character Recognition (OCR) method.

Simultaneously generating an identical initial code may comprise simultaneously running the same code generation algorithm in said vault processor and in the system server.

The initial code generation algorithm may receive as parameters date, time and vault ID.

The generated initial code may be temporary.

The personal code may comprise at least one biometric identification parameter.

The at least one biometric identification parameter may be selected from the group consisting of a fingerprint and an iris scan.

The method may further comprise repeating said steps of providing by said user a personal code to said vault; and unlocking said vault.

According to a second aspect of the present invention there is provided a system for using a vault, comprising: a plurality of vaults, each vault comprising a door, visible ID, a processor and input means; a system server; and a plurality of users' mobile communication devices, each running a user application (UA) and communicating bi-directionally with said system server; wherein said system server comprises: an initial code generation module for each one of said plurality of vaults; a vaults database; a users' database; and a fees calculation module; and wherein each one of said vaults comprises: an initial generation; a vault user inerface; and a personal code module.

The vaults database may comprise, for each vault, at least part of the data in the group consisting of: vault address, tariff, status and start time of current busy status.

The users database may comprise, for each user, at least part of the data in the group consisting of name, address, payment card number, phone number, email address and currently used vault ID.

The system server's initial code generation module and the vault's initial code generation module may be configured to generate identical initial codes.

The vaults input means may comprise at least one of a touch screen and biometric identification means.

BRIEF DESCRIPTION OF THE DRAWINGS

For better understanding of the invention and to show how the same may be carried into effect, reference will now be made, purely by way of example, to the accompanying drawings.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF EMBODIMENTS

The following description is presented to enable one of ordinary skill in the art to make and use the invention as provided in the context of a particular application and its requirements. Various modifications to the described embodiments will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed. In other instances, well-known methods, procedures, and components have not been described in detail so as not to obscure the present invention.

In the following detailed description, numerous specific details are set forth in order to provide a thorough understanding of the present invention. However, it will be understood by those skilled in the art that the present invention may be practiced without these specific details.

The term "vault" as used throughout this specification covers any type of safety boxes, such as safe deposits (i.e. bank vaults) and particularly ATM (Automated Teller Machine) and SST (Self Service Terminal) devices, which are prevented from an unauthorized access and which are equipped with mechanical and/or electromechanical lock devices and are geographically stationary or mobile.

The present invention provides a method and system for opening a terminal vault or safe responsive to two security codes, where the first security is supplied by the system and the second security code is a private code supplied by the user.

Figure 1:
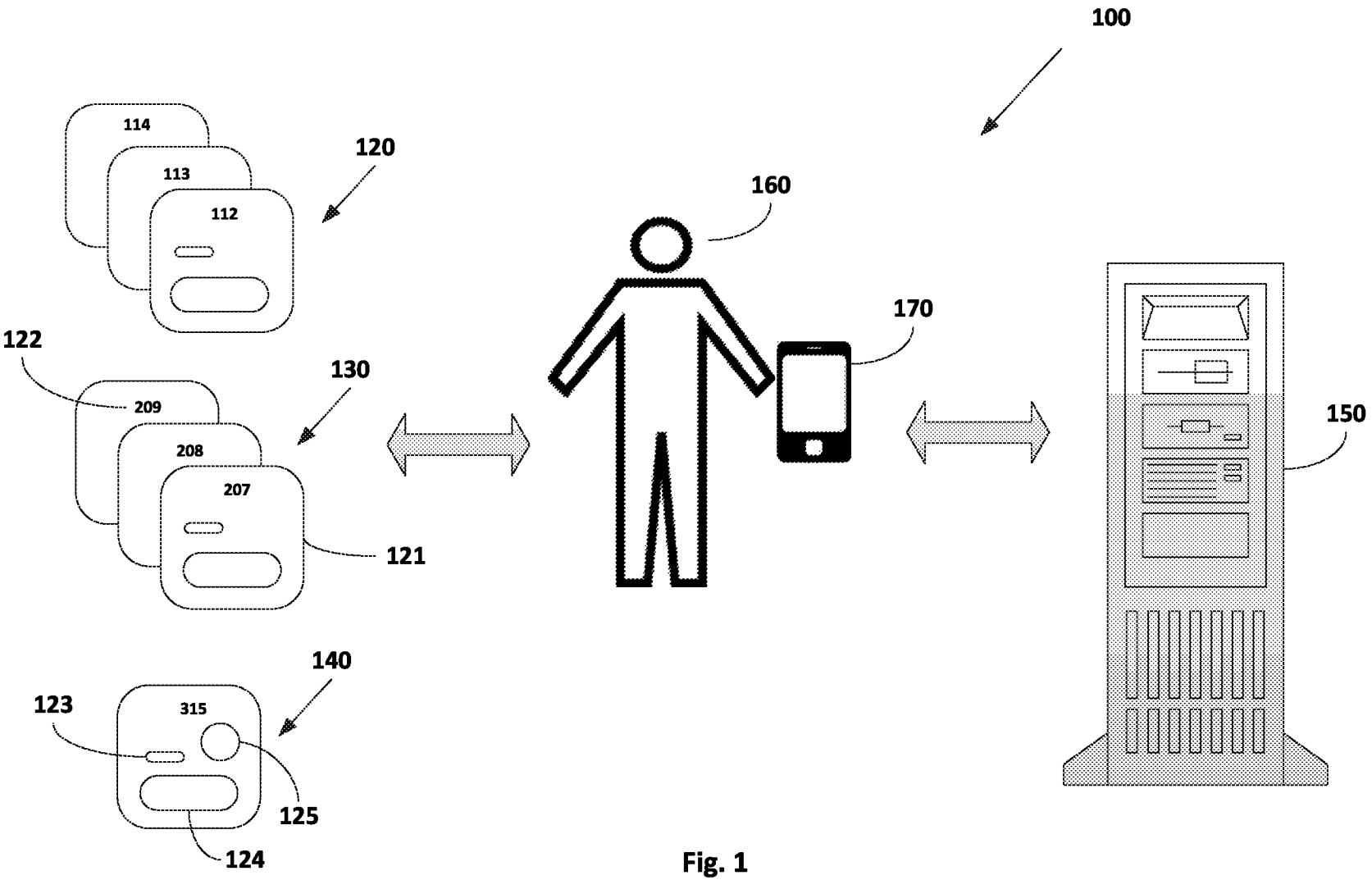
FIG. 1 is a schematic diagram of the system including the various components required for the operation of the present invention.

FIG. 1 is a schematic diagram of the system 100 including the various components required for the operation of the present invention:

- A plurality of vaults or safe deposit boxes ("vaults"), comprising groups of vaults (120, 130), each group located at one location, and/or single vaults (140). Each vault comprises a door 121, a visible ID (e.g. serial number or any name or alphanumeric indicia) of the vault 122, a keyhole 123, input means 124, such as a touch screen (or optionally a display screen and a keyboard) and optionally a biometric input device 125, such as a fingerprint scanner, an iris scanner, or any other biometric identification means.
- A system server 150, preferably a web server, which can be a centralized server or a plurality of distributed servers communicating with each other or with a central server.
- A plurality of users' mobile communication devices (only one shown) 170 (e.g. smartphone, laptop, Google glasses, any wearable device) hosting and running a user application (UA) for communicating bi-directionally between the system server 150 and the user 160, wherein the UA comprises a Graphical User Interface (GUI).

Figure 2:
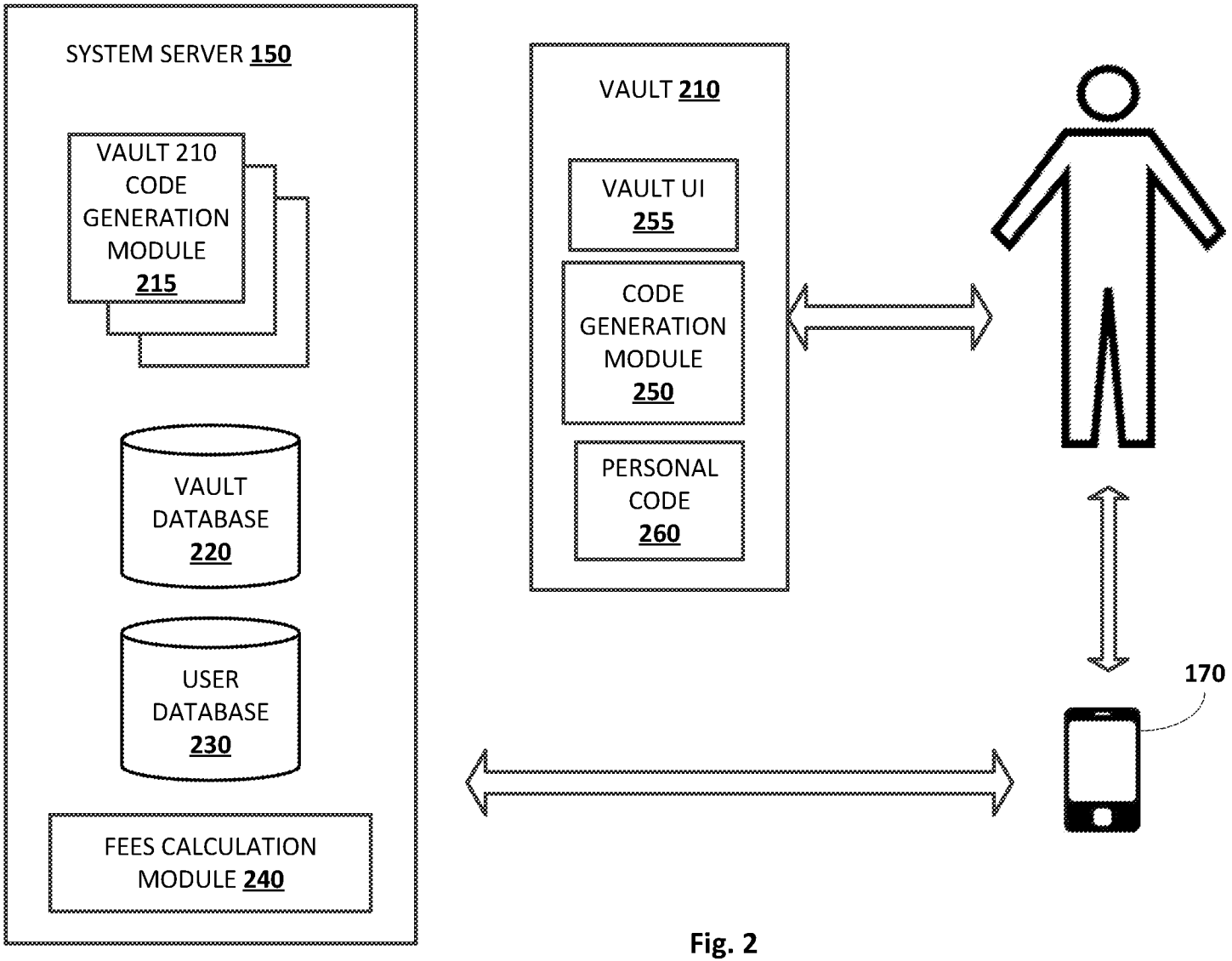
FIG. 2 is a schematic diagram of the various modules residing on the system server and in each single vault.

FIG. 2 is a schematic diagram of the various modules residing on the system server 150 and in each single vault 210.

According to embodiments of the invention, system server 150 comprises:

- An initial code generation module 215 for each vault registered in the system, as will be explained in details below.
- A vaults database 220, comprising operational data for each vault, such as: vault address, tariff, status (busy/free), start time of current busy status, etc.
- A users database 230, comprising personal details of each registered user, such as: name, address, payment card number, phone number, email address, etc.

The users database 230 may also comprise, for each user, a vault ID currently in use.

- A fees calculation module 240, for calculating and transmitting to the user application an initial tariff at the beginning of a session and the total sum to be paid at the end of a session.

According to embodiments of the invention, vault 210 comprises a processor for enabling:

- A code generation module 250, running the same algorithm as that of the respective vault code generation module 215 on the server, as will be explained in details below.

A vault User Interface (UI) module 255, for communicating bi-directionally with the user.

A personal code module 260, for receiving the user's personal code and saving it for the end of session, as will be explained in details below.

Figure 3:
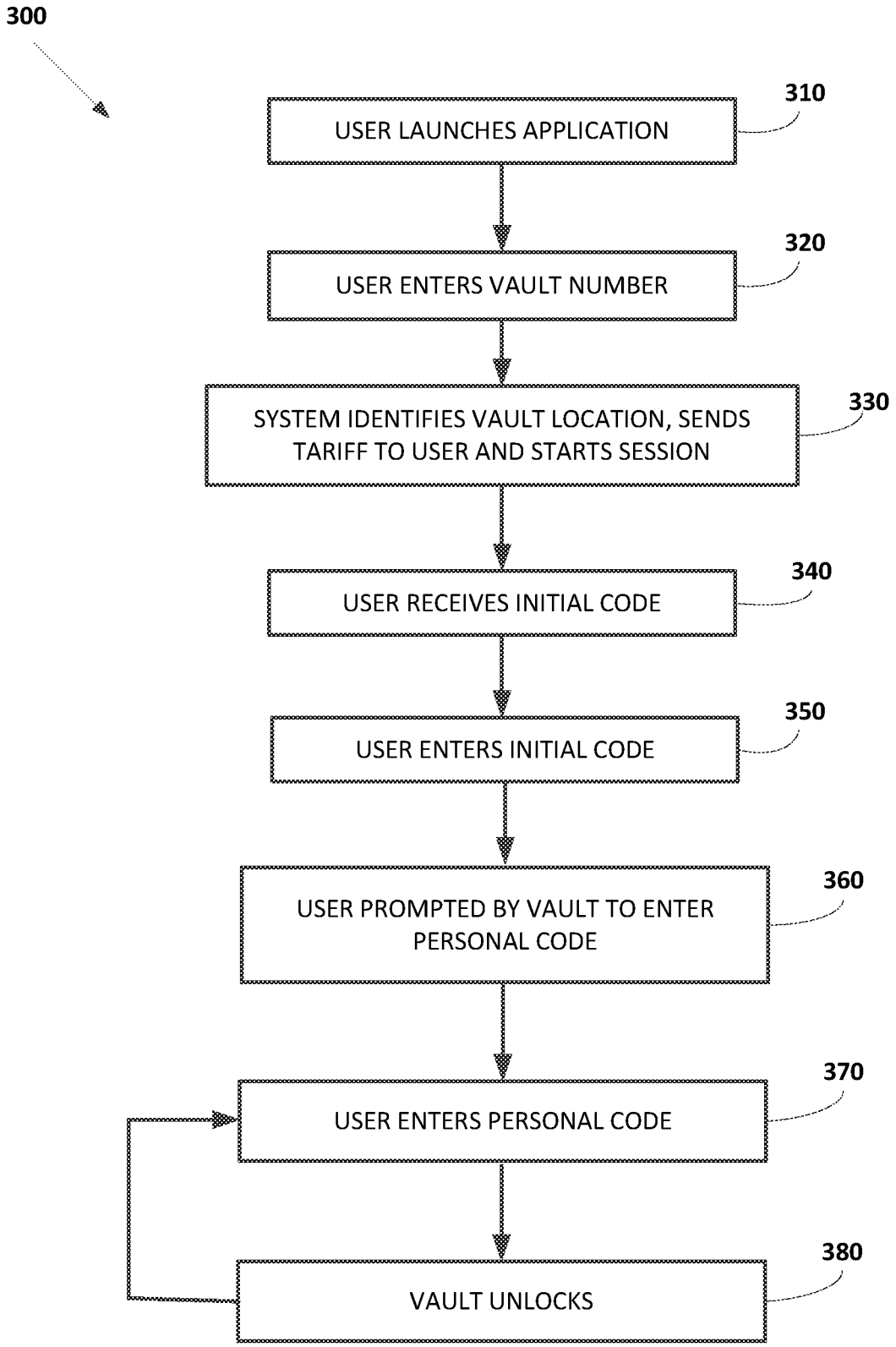
FIG. 3 is a flowchart showing the steps taken by a registered user when he wishes to use a vault.

FIG. 3 is a flowchart 300 showing the steps taken by a registered user when he wishes to use a vault.

In step 310 the user, standing in front of a vault, launches the user application (UA), enters his username and password, and is prompted by the user interface to enter the vault ID 122.

In step 320 the user enters the vault ID, which is transmitted by the UA to the server.

According to embodiments of the invention, the user may alternatively capture an image of the vault ID with his mobile communication device's capturing means (e.g. camera), whereby the UA may apply any known means of image processing and Optical Character Recognition (OCR) to detect the vault ID.

The system server identifies the vault location by its ID and the user by his username or by his device, e.g. using sensor fingerprinting or mobile identification number (MIN).

The system server fee calculation module 240 compiles a tariff (e.g. hourly rate, full day rate, etc.), which may take into consideration the vault location, the time of day, the user (e.g. frequent user) and more.

The system server sends the tariff to the UA, where it is displayed to the user (step 330).

When the user indicates acceptance of the tariff (possibly accompanied by time limits or other conditions), the UA reports session start to the server with the initial code for identification.

the system server sends the UA an initial code for opening the indicated vault (step 340) and the user enters the initial code on the vault touch screen (step 350). Since the same code generation algorithm runs simultaneously on both the code generation module 215 for the vault and the vault code generation module 250, the initial code received from the system server is verified by the vault.

In step 360 the user is prompted by the vault touch screen to enter a personal code before the expiration of the initial code. The personal code may be a numeric or alphanumeric code typed on the vault touch screen 124. Alternatively, and depending on the vault's configuration, the personal code may be a fingerprint, an iris scan, or any other biometric identification parameter.

The user now enters his personal code on the vault touch screen (step 370) and the vault unlocks (step 380). The sequence of entering the personal code and unlocking the vault may be repeated numerous times within the limitations set at the beginning of the session (e.g. time).

Figure 4:
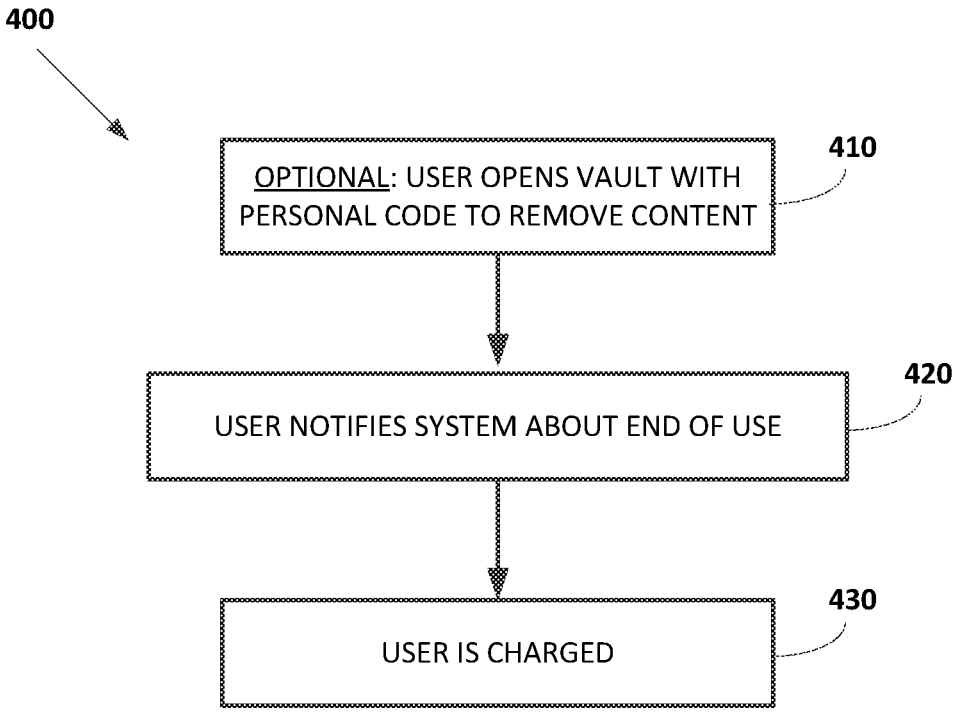
FIG. 4 is a flowchart showing the steps taken by a registered user when he wishes to terminate usage session of a vault.

FIG. 4 is a flowchart 400 showing the steps taken by a registered user when he wishes to terminate usage session of a vault.

If the vault still contains user's belongings, in step 410 the user enters his personal code on the vault's touch screen. Alternatively, and depending on the vault's configuration, the user may operate a fingerprint scanner, an iris scanner, or any other biometric identification means which he used for entering the personal code. The vault may now be opened.

In step 420 the user uses the UA on his mobile communication device to notify the system about the end of session. The UA communicates the information to the system server 150, where the fees calculation module 240 calculates the fees to be charged according to the initial tariff and the user payment card is charged.

Figure 5:
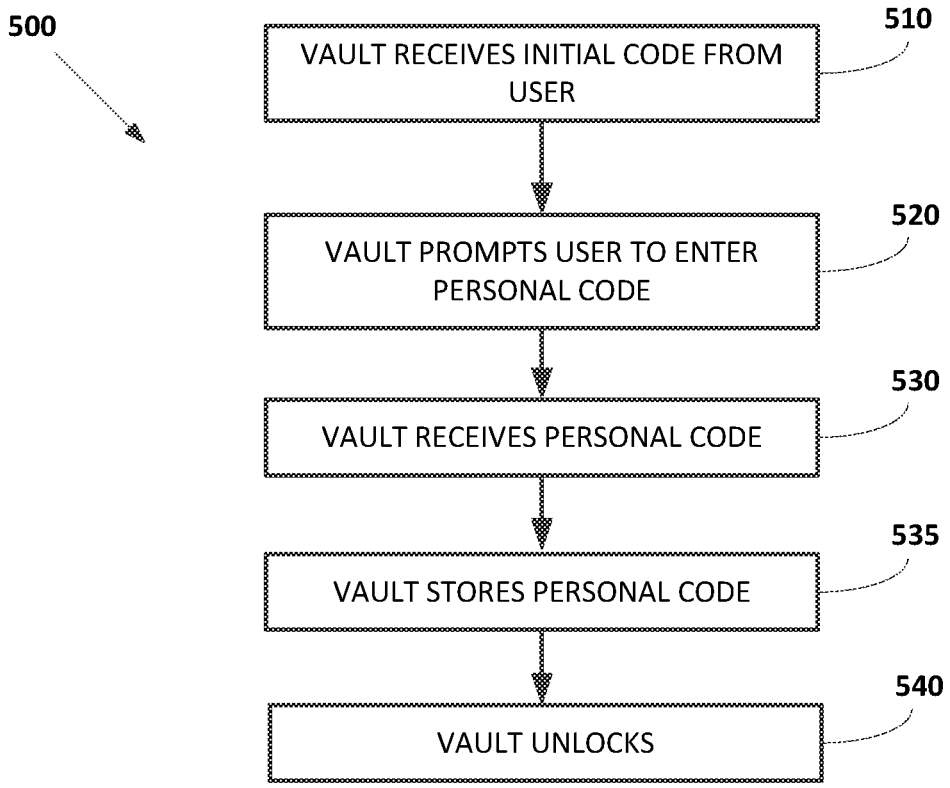
FIG. 5 is a flowchart showing the steps taken by the vault at a session start.

FIG. 5 is a flowchart 500 showing the steps taken by the vault at a session start.

In step 510 the vault UI receives from the user an initial code, which is the same code received by the UA from the server. The initial code is verified by the vault as being identical to the code calculated by the same algorithm running in the vault code generation module 250.

In step 520, the vault UI module 255 prompts the user to enter a personal code, receives the personal code (step 530), stores it (step 535) and the vault is unlocked.

The initial code provided by the system has, for example, 4 decimal digits and is based on core parameters consisting of date, time and vault ID. A number of constraints are applied:

The code should be deterministic, namely determined by the core parameters and no other parameters.

The code should be randomal to the user, namely statistically it is impossible to differentiate between the code and any other uniform random variable.

Any change in the core parameters should have a significant impact on the generated code.

The code is temporary for a few minutes and never repeats itself.

The foregoing description of the embodiments of the invention has been presented for the purposes of illustration and description. It is not intended to be exhaustive or to limit the invention to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the invention.

The invention claimed is:

1. A method of using a vault, comprising:

(a) providing a plurality of vaults, each comprising a processor;

(b) providing a user application (UA) running on a user's mobile communication device, said UA comprising a Graphical User Interface (GUI);

(c) providing a system server communicating bi-directionally over an electronic communications network with said UA;

(d) providing a vault ID to said GUI;

(e) identifying said vault location, providing a tariff for using said identified vault to said UA and receiving said user's acceptance;

(f) simultaneously generating an identical initial code by said system server and by said vault and providing said initial code to said UA;

(g) providing by said user said initial code to said vault;

h. validating said initial code by said vault;

(i) providing by said user a personal code to said vault; and (j) unlocking said vault.

2. The method of claim 1, wherein said vault ID comprises one of a number, a name and an alphanumeric indicia.

3. The method of claim 1, wherein said providing a vault ID comprises entering the vault ID into said GUI.

4. The method of claim 1, wherein said providing a vault ID comprises capturing an image of said vault ID with capturing means of said user's mobile communication device.

5. The method of claim 4, further comprising identifying said vault ID from said captured image.

6. The method of claim 5, wherein said identifying comprises applying an Optical Character Recognition (OCR) method.

7. The method of claim 1, wherein said simultaneously generating an identical initial code comprises simultaneously running the same code generation algorithm in said vault processor and in the system server.

8. The method of claim 7, wherein said initial code generation algorithm receives as parameters date, time and vault ID.

9. The method of claim 7, wherein said generated initial code is temporary.

10. The method of claim 1, wherein said personal code comprises at least one biometric identification parameter.

11. The method of claim 10, wherein said at least one biometric identification parameter is selected from the group consisting of a fingerprint and an iris scan.

12. The method of claim 1, further comprising repeating said steps (i) and (j).

13. A system for using a vault, comprising:

a plurality of vaults, each vault comprising a door, visible ID, a processor and input means;

a system server; and a plurality of users' mobile communication devices, each running a user application (UA) and communicating bi-directionally with said system server; wherein said system server comprises:

an initial code generation module for each one of said plurality of vaults; —a vaults database;

a users' database; and a fees calculation module; and wherein each one of said vaults comprises:

an initial code generation module;

a vault user interface; and a personal code module; wherein said system server's initial code generation module and said vault's initial code generation module are configured to simultaneously generate identical initial codes.

14. The system of claim 13, wherein said vaults database comprises, for each vault, at least part of the data in the group consisting of: vault address, tariff, status and start time of current busy status.

15. The system of claim 13, wherein said users database comprises, for each user, at least part of the data in the group consisting of name, address, payment card number, phone number, email address and currently used vault ID.

16. The system of claim 13, wherein said vaults input means comprise at least one of a touch screen, a keyboard and biometric identification means.

17. The system of claim 13, wherein said personal code module is configured to receive at least one biometric identification parameter.

* * * * *